US008057254B1

(12) United States Patent
Yang et al.

(10) Patent No.: US 8,057,254 B1
(45) Date of Patent: Nov. 15, 2011

(54) BATTERY HOLDER

(75) Inventors: Sheng-Ho Yang, Tu-Cheng (TW); Chun-Chieh Yang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/819,233

(22) Filed: Jun. 21, 2010

(30) Foreign Application Priority Data

Oct. 27, 2009 (TW) ..... 98219746 U

(51) Int. Cl.
*H01R 3/00* (2006.01)

(52) U.S. Cl. ..... 439/500

(58) Field of Classification Search ..... 439/500
See application file for complete search history.

(56) References Cited

U.S. PATENT DOCUMENTS

2003/0124902 A1* 7/2003 Wu ..... 439/500
2009/0017674 A1* 1/2009 Chen et al. ..... 439/500
2009/0156052 A1* 6/2009 Chen ..... 439/500

FOREIGN PATENT DOCUMENTS

CN 201130676 Y 10/2008

* cited by examiner

*Primary Examiner* — Tho D Ta
(74) *Attorney, Agent, or Firm* — Wei Te Chung; Andrew C. Cheng; Ming Chieh Chang

(57) ABSTRACT

A battery holder includes an insulative housing with a bottom base and a side wall to commonly define a receiving space, the side wall includes a seat portion with a receiving slot and an opening slot perpendicular to the receiving slot. A negative contact includes a contacting arm slanting to the receiving space from the bottom base and a positive contact includes a frame portion retained in the receiving slot and the contacting portion defined in the frame portion projecting in the receiving space through the opening portion. The contacting portion is integrally connects with the frame portion by two opposite ends thereof.

10 Claims, 5 Drawing Sheets

BATTERY HOLDER

BACKGROUND OF THE INVENTION

1. Field of the Invention

The present invention relates to the art of electrical connectors, and more particularly, to a battery holder for a coin battery.

2. Description of Related Art

More recently, the coin battery has been utilized in computers, microprocessors, calculators and many other electronic units and systems. With the development of technology, a safe and stable need for a battery holder for the coin battery has been arisen.

Chinese Utility Patent No. CN201130676 (referred to as the '676 patent for short) issued to DeXiang Zhu on Oct. 8, 2008 discloses a battery holder for holding a coin battery therein. Referring to the figures in the '676 patent, the battery holder in which the coin battery 4 is retained includes a retaining housing 1, a negative terminal 2 and a positive terminal 3. Said positive contact 3 vertically received in a bottom near a side of the retaining housing 1. The positive contact 14 has a cantilever 312 extending inwardly as a contact portion to touch a side of the battery. An elastic plate 12 is set around the cantilever 312. However, when the battery 4 is moved to the battery holder, said cantilever 312 is deformed itself to contact the battery 4 and dispersed a little force to the main body of the positive contact 14 and the elastic plate 12. The cantilever 312 can't supply enough force to fasten the battery 4 to keep a stable electrical connection.

It is thus desirable to provide a battery holder that alleviates and even overcomes the above disadvantages.

SUMMARY OF THE INVENTION

Accordingly, the object of the present invention is to provide a battery holder with an improved contact to ensure a coin battery to be fitly received therein.

In order to achieve the object set forth, A battery holder includes an insulative housing with a bottom base and a side wall to commonly define a receiving space, the side wall includes a seat portion with a receiving slot and an opening slot perpendicular to the receiving slot. A negative contact includes a contacting arm slanting to the receiving space from the bottom base and a positive contact includes a frame portion retained in the receiving slot and the contacting portion defined in the frame portion projecting in the receiving space through the opening portion. The contacting portion is integrally defined with the frame portion by two opposite ends thereof.

Other objects, advantages and novel features of the invention will become more apparent from the following detailed description when taken in conjunction with the accompanying drawings.

DETAILED DESCRIPTION OF THE INVENTION

Figure 1:
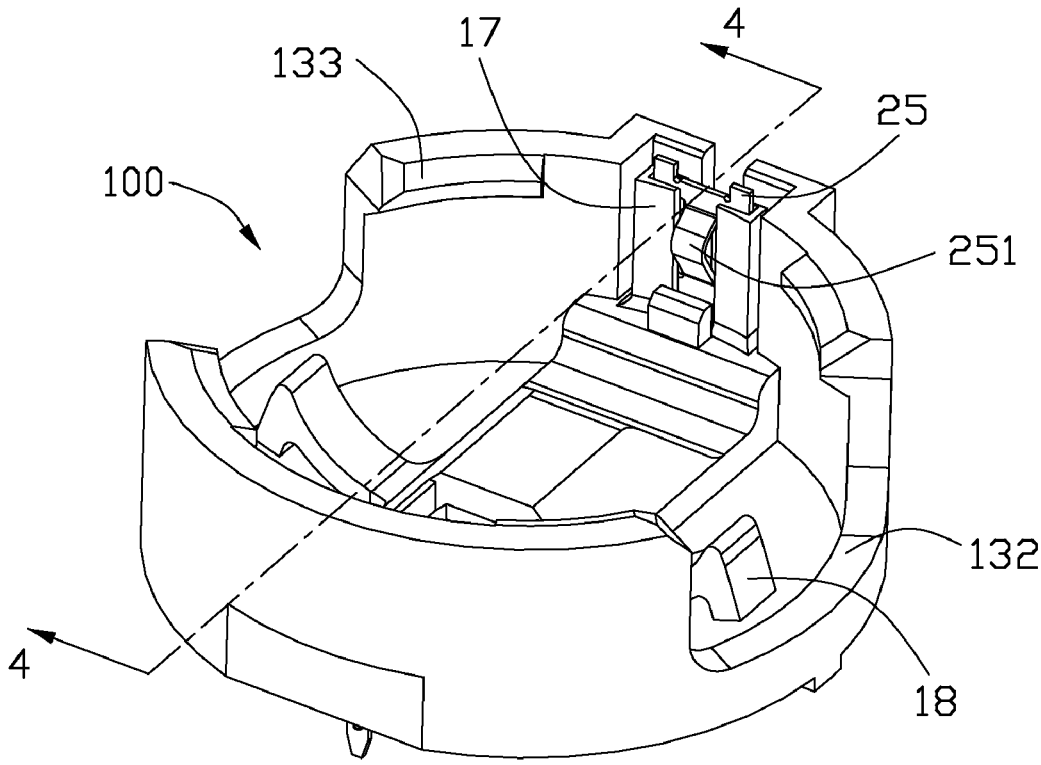
FIG. 1 is an assembled, perspective view of the battery holder of an embodiment of the present invention.
Figure 2:
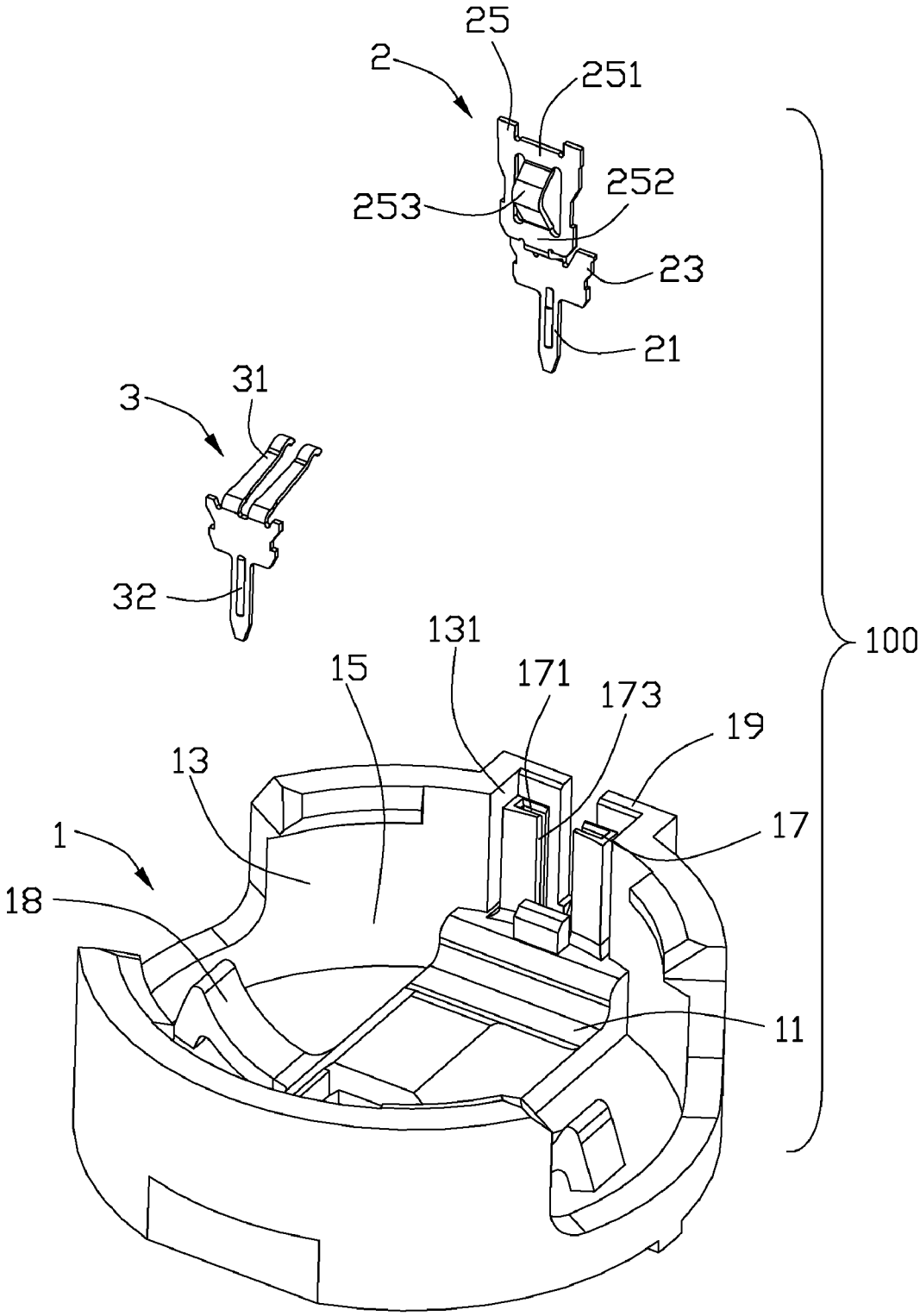
FIG. 2 is an exploded, perspective view of the battery holder as shown in FIG. 1.
Figure 3:
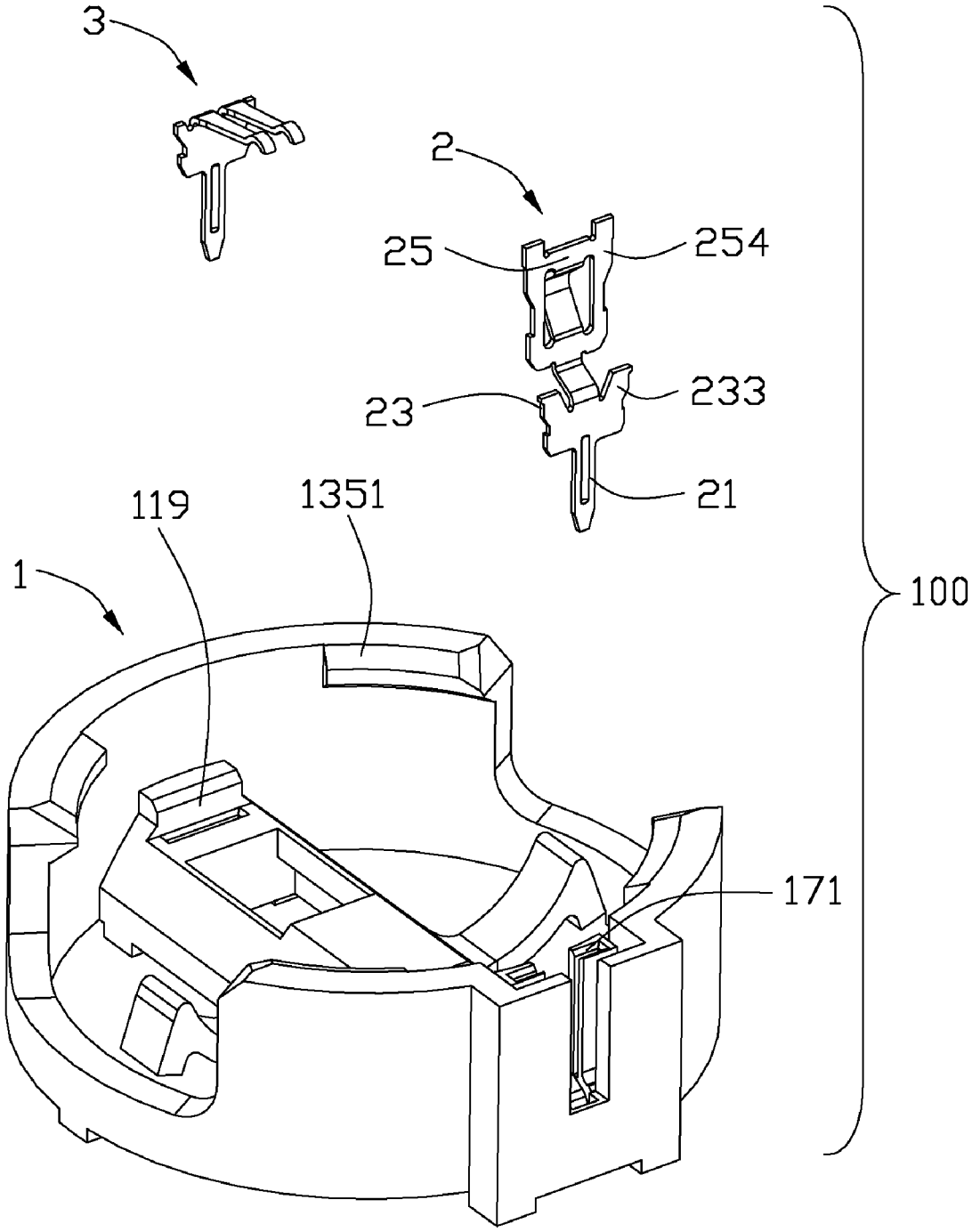
FIG. 3 is an another exploded, perspective view of the battery holder as shown in FIG. 1.
Figure 4:
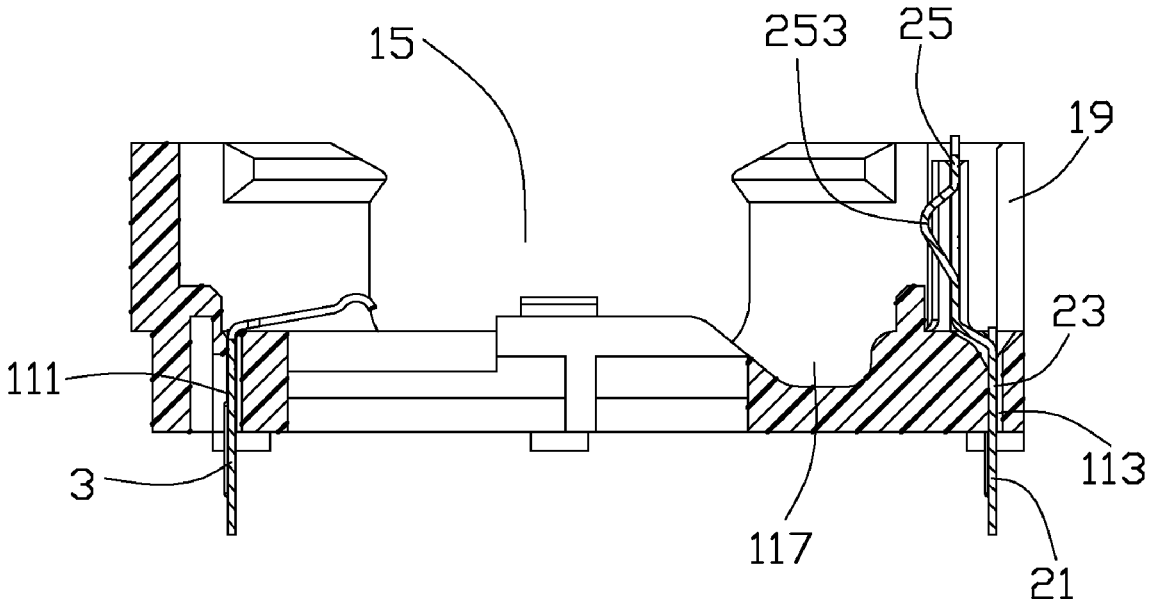
FIG. 4 is a cross-sectional view of the battery holder taken along line 4-4 shown in FIG. 1.

Reference will now be made in detail to the preferred embodiment of the present invention.

Referring to FIGS. 1-4, the present invention provides a battery holder 100 for accommodating a battery (not shown). The battery holder includes an insulative housing 1, a positive contact 2 and a negative contact 3.

The housing 1 includes a bottom base 11 and a ring sidewall 13 to together define a receiving space 15 for receiving the battery. The sidewall 13 of the housing 1 defines an outward cut portion 131 at one point to situate the positive contacts 2. The bottom base 11 is of a bean along an axis across the cut portion 131 and a pair of spring arms 18 slanting upwards from two opposite sides of the beam and perpendicular to the axis. The sidewall 13 further defines a pair of upward notch 132 at a middle portion of the semicircle sidewall divided about the axis. Four inwards projections 133 situated at the vicinity of the upward notches 132. The inwards projections 133 and the spring arms 18 can fitly retained the battery in the receiving space 15.

A seating wall 17 is integrally formed in the cut portion 131 with a receiving slot 171 opening upward along a direction perpendicular to the axis and a opening slot 173 running through not only the seating wall 17 but also the sidewall 13 along the axis. The opening slot 173 communicates with the receiving space 15. The insulative housing 1 further includes a protecting wall 19 integrally formed at the cut portion 131 and separately behind the seating wall 17. A predetermined distance is provided between the seating wall 17 and the protecting wall 19 so that the spring wall 17 can deform in the cut portion 131.

The negative contact 3 includes a pair of contacting portion 31 and a leg 32 extending downwards. The leg 32 is fixed in a through hole 111 (labeled in FIG. 4) defined in the bottom base 11 near to the sidewall 13 opposite to the cut portion 131 and the contacting portions 31 with elasticity is slanting to the receiving space.

The positive contact 2 includes a retention base 23 with tabs 233 at lateral sides thereof, a tail 21 extending from a lower edge of the base 23 and a frame portion 25 extending from an upper edge of the base 23. The frame portion 25 with first interference tabs 254 formed on both lateral side is engaged in the receiving slot 171 and the base 31 with tab 233 is fixed in a through hole 113. The frame portion 25 defines a contacting portion 253 with an inverted V shape protruding in the receiving space 15 through the opening slot 173. The contacting portion 253 is formed by cutting a belt portion in the middle of the frame portion 25 and then spreading the belt portion to the inverted V shaped with a tip projecting to the receiving space 15, i.e., the contacting portion 253 integrally connecting with an upper edge 251 and a lower edge 252 of the frame portion. The contacting portion 253 integrally formed with the frame portion 25 at two opposite ends thereof.

When the battery is needed to be installed into the battery holder 100, one end of the battery is placed in a hollow 117 below the inwards projections 133, and then the other end is pressed downwardly. A block 119 is formed on the bottom base 11 for anti-mismating. During the pressing process, bevels 1351 of the inwards projections 133 defined on the sidewall 13 can guide the battery to enter in the receiving space 15, which forces the contacting portion 253 to deform outwardly until the battery is below all the inwards projections 133. Thus, the battery is positioned in the receiving space 15 by virtue of the cooperation between the inwards projections 133 and the contacting portion 253. It is worth mentioning that the contacting portion 253 is a closed structure, which can disperse more force to the frame portion 25 of the positive contact 2 and to the seating wall 17. It also keeps stable electrical connection to the battery so that a certain vibration is allowed. If a user wants to remove the battery from the receiving space 15, the user should force above the battery near one of the upward notch 132 to make the spring arms 18 deform downwardly for releasing the battery.

Figure 5:
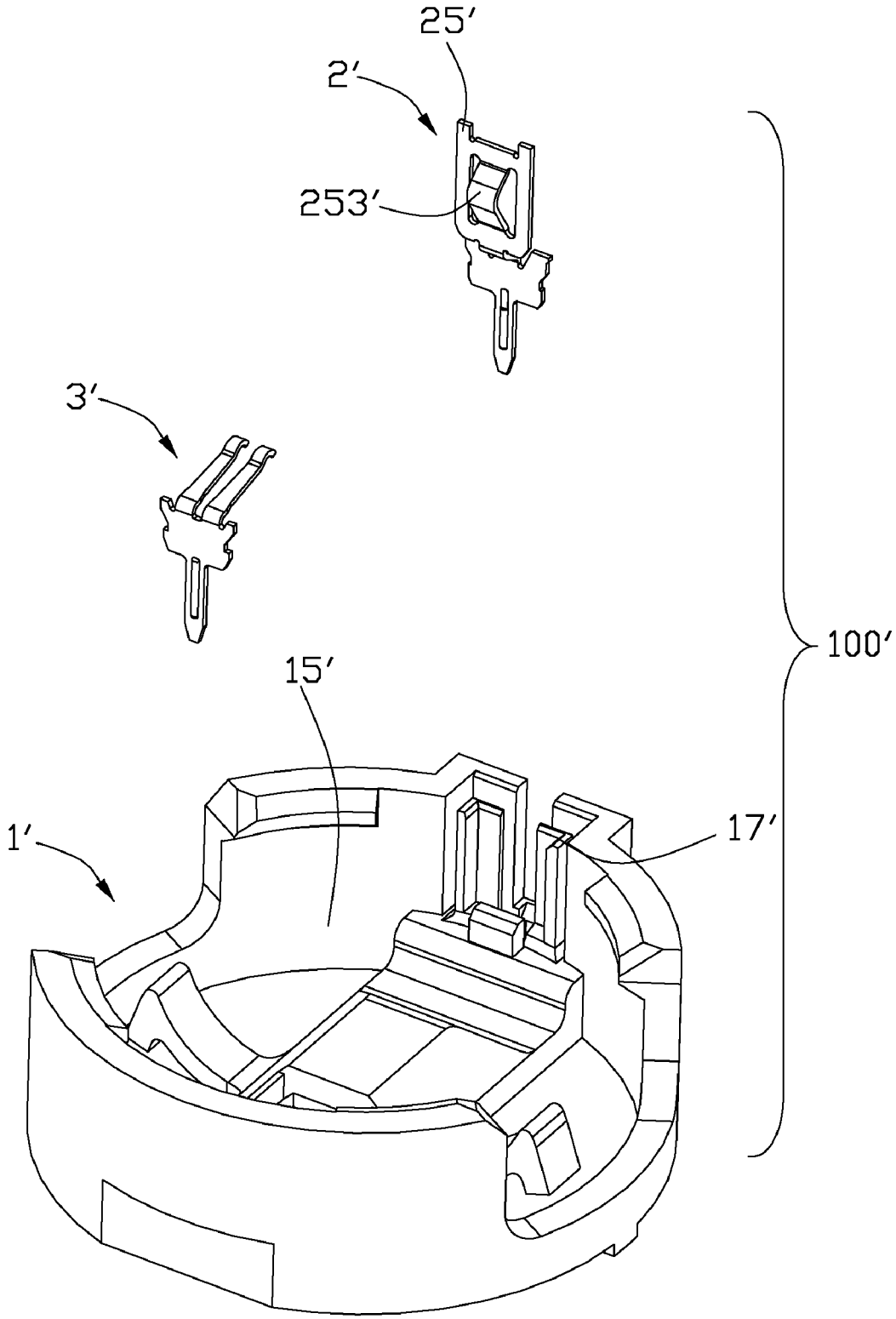
FIG. 5 is a perspective view of a battery holder of a second embodiment of the present invention.

Referring to FIG. 5, It is noted that the positive contact can also be defined out of the seating wall. In this embodiment of the battery holder 100', the seating wall 17' opens inwards and upward and the frame portion 25' of the positive contact 2' is located in the inside of the seating wall 17'. During the outwardly deforming process of the contacting portion 253', the seating wall 17' can co-roll with the positive contact 2', which will also disperse the force and take protection to the positive contact 2'.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A battery holder, comprising:

an insulative housing comprising a bottom base and a side wall to commonly define a receiving space, the side wall defining a seating wall with receiving slot and an opening slot perpendicular to the receiving slot; and a negative contact comprising a contacting arm slanting to the receiving space from the bottom base; and a positive contact comprising a frame portion retained in the receiving slot and a contacting portion defined in the frame portion projecting in the receiving space through the opening slot; wherein the contacting portion integrally connects with the frame portion at two opposite ends thereof;

wherein the sidewall further defines a pair of upward notch at a middle portion of a semicircle sidewall divided about an axis across the seating wall, a pair of spring arms slanting upwards from the bottom base and perpendicular to the axis.

2. The battery holder as claimed in claim 1, wherein interference tabs are formed on both lateral sides of the frame portion of the positive contact and retained in the receiving slot.

3. The battery holder as claimed in claim 1, wherein a hollow with an incline to the edge of the sidewall is formed on the bottom base near to a root of the seating wall.

4. A battery holder, comprising:

an insulative housing comprising a bottom base and a side wall to commonly define a receiving space, a cut portion formed on the sidewall of the housing and a spring wall extending from an edge of the bottom base and located in the cut portion; and a negative contact comprising a contacting arm slanting to the receiving space from the bottom base; and a positive contact defining a frame portion with a contacting portion projecting in the receiving space; wherein the contacting portion operates in a full support manner and is integrally formed on the frame portion, and the spring wall can be co-moved outwardly with the frame portion so as to have reaction forces derived from a battery and imposed upon the contacting projection essentially mostly transferred to the spring wall;

wherein the sidewall further defines a pair of upward notch at a middle portion of a semicircle sidewall divided about an axis across the frame portion, a pair of spring arms slanting upwards from the bottom base and perpendicular to the axis.

5. The battery holder as claimed in claim 4, wherein the spring wall defines a seating wall with a receiving slot and an opening slot perpendicular to the receiving slot, the frame portion of the positive contact is retained in the receiving slot and the contacting portion projects to the receiving space through the opening portion.

6. The battery holder as claimed in claim 5, wherein a hollow with an incline to the edge of the sidewall is formed on the bottom base near to a root of the seating wall.

7. The battery holder as claimed in claim 6, wherein the contacting portion is in an inverted V shape integrally connect with an upper edge and a lower edge of the frame portion.

8. A battery connector for use with a battery, comprising:

an insulative housing defining a bottom base and a circumferential wall upwardly extending from a circumference of said bottom base and cooperating with said bottom base to commonly define a columnar receiving space for receiving the inserted battery;

a plurality of projections formed at a top edge region of the circumferential wall to form downward blocking against the receiving space;

a pair of spring arms unitary extending outwardly and upward from a centerline area of a platform of the bottom base in an oblique while opposite manner for cooperating with the projections to hold a battery in the receiving space;

a negative contact received in the platform of the bottom base with a contacting arm upwardly and obliquely extending into the receiving space; and a positive contact received in the circumferential wall with a contacting portion laterally extending into the receiving space under condition that said contacting portion extends in a vertical direction in an elevational view; wherein said projections are essentially immovable so that a portion of the inserted battery is required to be tilted by one side of the centerline area of the platform and press downwardly the corresponding spring arm for making an opposite portion of the battery upwardly tilted to escape restriction of the corresponding projections;

wherein in a top view, a first line defined by the negative contact and the positive contact is perpendicular to a second line defined by said pair of spring arms.

9. The battery connector as claimed in claim 8, wherein said first line intersects said second line at a center of said bottom base.

10. The battery connector as claimed in claim 8, wherein said positive contact defines a frame structure, and the contacting portion unitarily extends from at least one inner edge of said frame structure.

* * * * *